United States Patent [19]

Jünemann et al.

[11] Patent Number: 4,709,709

[45] Date of Patent: Dec. 1, 1987

[54] PROCESS FOR THE MOISTENING OF COMMINUTED SMOKING MATERIALS

[75] Inventors: Gitta Jünemann; Werner Hirsch, both of Hamburg; Arno Weiss, Delingsdorf, all of Fed. Rep. of Germany

[73] Assignee: B.A.T. Cigaretten-Fabriken GmbH, Fed. Rep. of Germany

[21] Appl. No.: 4,214

[22] Filed: Jan. 5, 1987

Related U.S. Application Data

[63] Continuation of Ser. No. 712,822, Mar. 18, 1985.

[30] Foreign Application Priority Data

Mar. 20, 1984 [DE] Fed. Rep. of Germany ..... 3410184

[51] Int. Cl.[4] ..... A24B 3/04; A24B 3/12

[52] U.S. Cl. ..... 131/306; 131/290; 131/300; 131/291

[58] Field of Search ..... 131/290, 299, 300, 302, 131/304, 306

[56] References Cited

U.S. PATENT DOCUMENTS

| | | | |
|---|---|---|---|
| 3,429,317 | 2/1969 | Koch et al. | 131/304 |
| 3,742,961 | 7/1975 | Waller | 131/306 |
| 3,978,867 | 9/1976 | Wochnowski | 131/300 |
| 4,054,145 | 10/1977 | Berndt et al. | 131/306 |
| 4,202,357 | 5/1980 | de la Burde et al. | 131/300 |
| 4,438,775 | 3/1984 | Mays et al. | 131/300 |

FOREIGN PATENT DOCUMENTS 2943375 10/1979 Fed. Rep. of Germany .

*Primary Examiner*—Vincent Millin
*Assistant Examiner*—H. Macey
*Attorney, Agent, or Firm*—Armstrong, Nikaido, Marmelstein & Kubovcik

[57] ABSTRACT

For the moistening of comminuted, more particularly overdried, smoking materials, the requisite quantity of water is applied in at least two spraying sections situated one in succession to the other, in which the water is divided into tiny droplets by means of ultrasonic atomizers. Cooling sections are arranged between the individual spraying sections.

7 Claims, 5 Drawing Figures cooling phases: 1 → a, b → c, d → e moistening phases: a → b, c → d, e → 2

PROCESS FOR THE MOISTENING OF COMMINUTED SMOKING MATERIALS

This application is a continuation of application Ser. No. 712,822 filed Mar. 18, 1985.

BACKGROUND OF THE INVENTION

1. Field of the invention

The invention relates to a process for the moistening of comminuted smokable or smoking materials, more particularly for the moistening of overdried smoking materials, wherein tiny droplets of water are applied to the comminuted smoking materials by means of ultrasonic atomisers.

The term "comminuted smoking materials" is to be understood as referring to tobacco leaf, de-ribbed tobacco leaf, tobacco rib, tobacco stalk, cut or shredded in each case, also reconditioned tobacco (extrudate, sheet) and tobacco substitutes. In the tobacco industry the tobacco moisture is defined as the weight loss expressed in % of the weigh-in quantity which the tobacco suffers by drying at 80° C. to the state of weight constancy, with a minimum drying time of 3 hours.

2. Description of the Prior Art

It is known for comminuted, more particularly overdried tobacco materials to be moistened in an air-conditioned cabinet or chamber. Owing to the considerable outlay on apparatus required, this method is generally used only for laboratory purposes, and in such cases operates non-continuously, i.e. a specific sample is moistened on which experiments are then to be carried out.

The outlay is usually too great to allow the method to be used for production purposes.

Belt humidifiers or moisteners are also known which operate with conditioned air. These also require a considerable outlay on apparatus. Nevertheless the moistening of the individual tobacco particles is not uniform.

The belt lining is also very expensive, so that as a result there are more particularly high operating costs.

Finally, so-called moistening drums have been developed in which the smoking materials are tumbled and are moistened by means of ultrasonic atomisers at the same time (German OS No. 2 943 373). But a result of this is considerable mechanical stress on the tobacco particles, often resulting in damage to the fibre structure which is being aimed at. This in turn leads to losses in filling capacity.

SUMMARY OF THE INVENTION

Therefore the invention has as its object to provide a process for the moistening of comminuted smoking materials of the category specified, wherein the above-mentioned disadvantages no longer occur.

More particularly a process is to be proposed with which comminuted, more particularly overdried, smoking materials can be moistened in a very uniform manner with a low outlay on apparatus.

Therefore the invention proposes a process for the moistening of comminuted smokable materials more particularly for moistening overdried smoking materials wherein a downwardly freely falling stream of comminuted smoking materials is moistened by ultrasonic atomisers, and wherein the moistened smoking materials are cooled. The advantages which are achieved with this invention are based more particularly on the fact that during treatment only minimal external forces act on the smoking materials, in other words the mechnical stressing is negligible, and consequently even in the case of brittle and therefore delicate smoking materials no damage to the fibre structure results. At the same time the combined moistening/cooling of the smoking materials gives a well-defined uniform moisture in the entire cut tobacco mass, so that partial shrinking of individual fibres cannot result, which in its turn would lead to a reduction in filling capacity.

The kinetic energy of the water droplets which are atomised by ultrasonic means corresponds substantially to their potential energy minus the lift and the resistance to movement of the falling water droplets; thus the impacts between the ultrasonically atomised water droplets of small size, for example with a mean diameter of the order of magnitude of 40 $\mu$m, and the downwardly trickling tobacco particles have substantially no influence on the movement of the tobacco.

Therefore, these ultrasonic atomisers can be installed at optional delivery points of conveying apparatus, more particularly conveyor belts or chutes, where they do not hinder the rest of production. It is also possible to equip a production line subsequently with such ultrasonic atomisers.

The conveying apparatus must transport the tobacco in such a way that a thin tobacco fleece is formed. This freely falling thin tobacco fleece, or the individual fibres of such a fleece, are sprayed with a very fine mist atomised by ultrasonic means, and are thus moistened in a well-defined manner.

The very narrow drop range of an ultrasonic atomiser can be set to a predetermined value by modifying the high-frequency electric currents energising the ultrasonic atomiser, and adjusted as and when necessary. With a suitable ultrasonic atomiser frequency it is possible to achieve a filling capacity increased by 5 to 30% as compared with moistening in drums using nozzles.

The number of delivery points which are used for moistening depends on the moisture to be achieved and/or the quality of the moistening control.

Various constructional forms of ultrasonic atomisers are available for the moistening of overdried comminuted smoking materials, the choice of the suitable type in each case depending inter alia on space circumstances.

A flexural-shaft atomiser can extend for example over the entire width of the freely falling tobacco fleece, whereas a plurality of axial atomisers or circular atomisers are arranged in parallel arrangement and side by side over the width of the tobacco fleece. The axial atomisers or circular atomisers may also be arranged one after the other laterally offset with respect to one another, and thereby cover the entire width of the tobacco fleece.

Finally, it is also possible to use ultrasonic atomisers operating without physical contact, these producing standing waves between two stationary plates.

The ultrasonic atomisers are advantageously supplied with a carrier medium, more particularly carrier air, which predetermines a direction of movement for the atomised water droplets and also prevents the accumulation of dirt in the ultrasonic atomisers.

It is in fact already known from U.S. Pat. No. 3,668,905 to moisten a fabric web in a closed housing. Here, an ultrasonic atomiser is situated on the bottom of the housing. Above the ultrasonic atomiser is the liquid to be atomised, this rising upwards as a mist and being deposited on the fabric web transported through the housing. German OS No. 3 108 481 shows an application of this idea to a moved fabric web of spread-out filter rope. A liquid softening agent is applied to the fabric web.

BRIEF DESCRIPTION OF THE DRAWINGS

The invention will be explained in more detail hereinafter with the use of examples of embodiment with reference to the accompanying diagrammatic drawings. In these drawings

DESCRIPTION OF THE PREFERRED EMBODIMENTS

The temperature and the moisture of comminuted tobacco materials, for example in the preparation of tobacco during the manufacture of cigarettes, together determine the mechanical properties of cut tobacco, and any fluctiations in the corresponding values are dependent on the tobacco type being dealt with.

Figure 1:
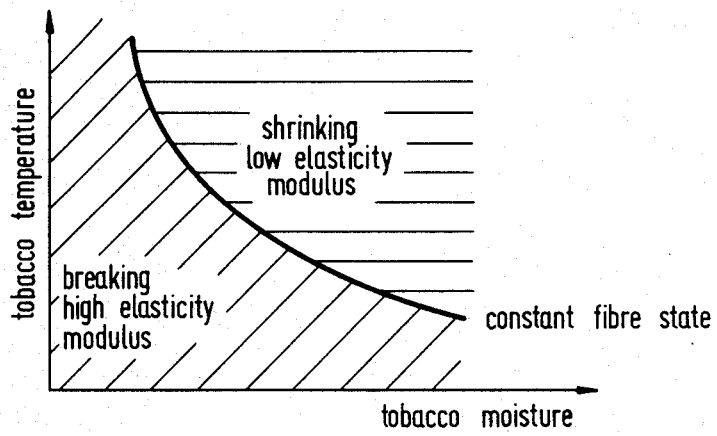
FIG. 1 shows the qualitative connection between the temperature and the moisture of comminuted tobacco materials.

There is a functional connection between tobacco temperature and tobacco moisture in the sense that in the case of specific pairs of values for these parameters the tobacco fibres do not break and/or do not shrink without the action of external forces when under certain external stresses such as occur for example during transport. This function can be represented by the constant fibre state, which is shown in FIG. 1 qualitatively for one specific tobacco type. It is shown that at values of moisture and temperature which are above the constant fibre state the tobacco has a low modulus of elasticity and consequently readily tends to shrink, whereas at values below the constant fibre state the tobacco has a high modulus of elasticity i.e. is extremely brittle, and thus breaks easily.

The elastic and plastically deformable properties of the tobacco fibres are reversible at each point of the constant fibre state. The tobacco has an optimal filling capacity and also retains this optimal filling capacity when any variations occur in the pair of values moisture/temperature very close to the constant fibre state.

Realisation of a process dealing with comminuted smoking materials where the values for moisture and temperature of the tobacco materials are as close as possible to the constant fibre state, is possible with an alternating succession of moistening and cooling sections, using ultrasonic atomisers to moisten i.e. to apply water.

Figure 2:
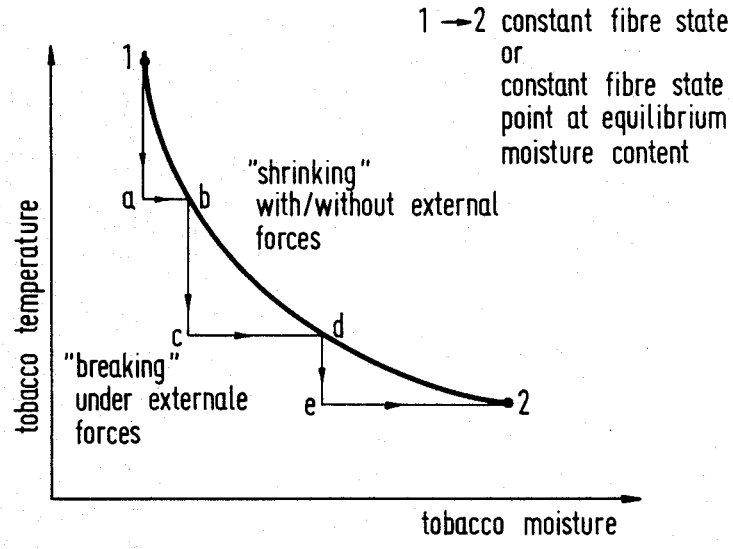
FIG. 2 shows a graph of the theoretical variation of tobacco moisture and temperature in accordance with the constant fibre state, and the course of a practical process.

FIG. 2 shows the corresponding process pattern wherein the comminuted tobacco materials are brought from the pair of values temperature/moisture at point 1 to the pair of values at point 2, substantially in conformity with the form of the constant fibre state.

It begins with a cooling phase, wherein the temperature of the tobacco materials is reduced from the value at point 1 to the value at point 2; there follows a moistening phase, in which the moisture of the tobacco materials is increased from the value at point a to the value at point b.

A cooling phase then follows again, in which the temperature is reduced from the value at point b to the value at point c, followed by a moistening phase wherein the moisture is increased from the value at point c to the value at point d. In respective further cooling and moistening phases the tobacco materials finally after passing through point e reach the temperature and moisture values at point 2 of the constant fibre state.

During the entire treatment the tobacco fibres have such mechanical properties that neither shrinking nor breaking of the fibres occurs under the action of external forces.

Figure 3:
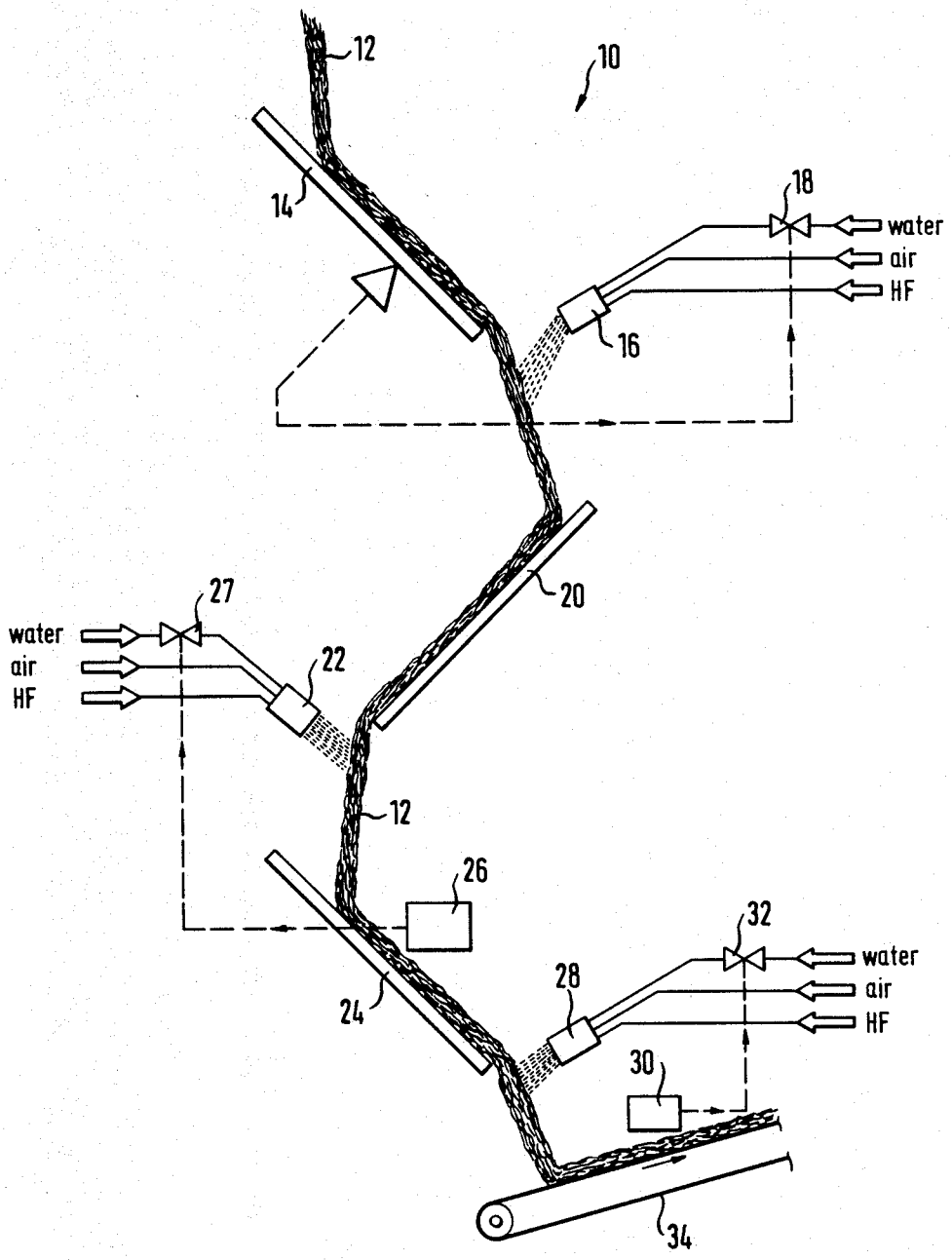
FIG. 3 shows a first form of embodiment of an apparatus for carrying out the moistening process according to the present invention.

The apparatus for the moistening of tobacco materials which is shown in FIG. 3 and is given the general reference numeral 10 comprises a "tobacco source" not shown here, from which a stream 12 of comminuted tobacco materials falls vertically downwards on to a baffle plate 14 and slides downwardly along this plate. The baffle plate 14 serves to detect the mass of the tobacco stream 12, which exerts on the baffle plate 14 a force which depends on the tobacco mass.

At the lower end the stream 12 of tobacco particles trickles freely downwards from the baffle plate 14. At this delivery point there is arranged an ultrasonic atomiser 16 which is supplied with a high-frequency current (HF), the water to be atomised, and a carrier medium more particularly air. A regulating unit 18 is situated in the conduit for the water supply, and sets the quantity of water to be atomised in dependence on the mass of the stream of tobacco ascertained at the baffle plate 14. This allows adjustment of the basic load at the first moistening station.

The moistened tobacco particles fall on to a chute 20 which is arranged in similar manner to the baffle plate 14, and at the lower delivery end of which a second ultrasonic atomiser 22 is arranged. water, air and HF energy are again supplied to this ultrasonic atomiser 22.

From the chute 20 the stream of tobacco 12 falls on to a second chute 24 on which the moisture of the moistened tobacco stream is ascertained by means of a hygrometer 26. The output signal from the hygrometer 26 influences a regulating unit 27 in the conduit for water supply to the second ultrasonic atomiser 22.

From the second chute the stream of tobacco 12 falls down on to a conveyor belt 34 which transports the moistened tobacco for further processing. This freely falling tobacco stream is also moistened by a third ultrasonic atomiser 28, which is supplied with water, air and HF energy. The moisture of the tobacco stream on the conveyor belt 34 is ascertained by means of a second hygrometer 30, which adjusts a regulating unit 32 in the conduit for water supply to the third ultrasonic atomiser 28.

Corresponding with the constant fibre state there should be the smallest application of moisture at the first delivery point and the highest at the last delivery point i.e. the first ultrasonic atomiser 16 should apply the smallest quantity of water and the third ultrasonic atomiser 28 the largest quantity of water. But for control art reasons, and owing to evaporation of part-quantities of water in accordance with tobacco temperature, the greatest application of moisture is effected at the first delivery point and the smallest at the last delivery point.

In the form of embodiment shown in FIG. 3 the whole quantity of water supplied could be divided as follows over the three ultrasonic atomisers:

(a) the first ultrasonic atomiser 16 should apply approximately 50% of the total quantity of water;

(b) the second ultrasonic atomiser 22 should apply approximately 30% of the total quantity of water;

(c) the third ultrasonic atomiser 28 should apply approximately 20% of the total quantity of water.

Presetting the frequency of the high-frequency current applied to the ultrasonic atomisers allows the drop range of the water droplets produced to be adjusted; this drop range remains constant in all moistening stages, and should give a maximum mean diameter of 60 μm. The preferred drop range is between 30 and 40 μm.

The conveying sections between the delivery points, in other words the baffle plate 14, the two chutes 20 and 24, and the conveyor belt 34 represent the cooling sections. The length of these conveying sections and thus the length of the cooling sections depends on environment conditions.

Supplying fresh air can accelerate the cooling of the tobacco materials and thus the length of the conveying or cooling sections can be reduced.

Figure 4:
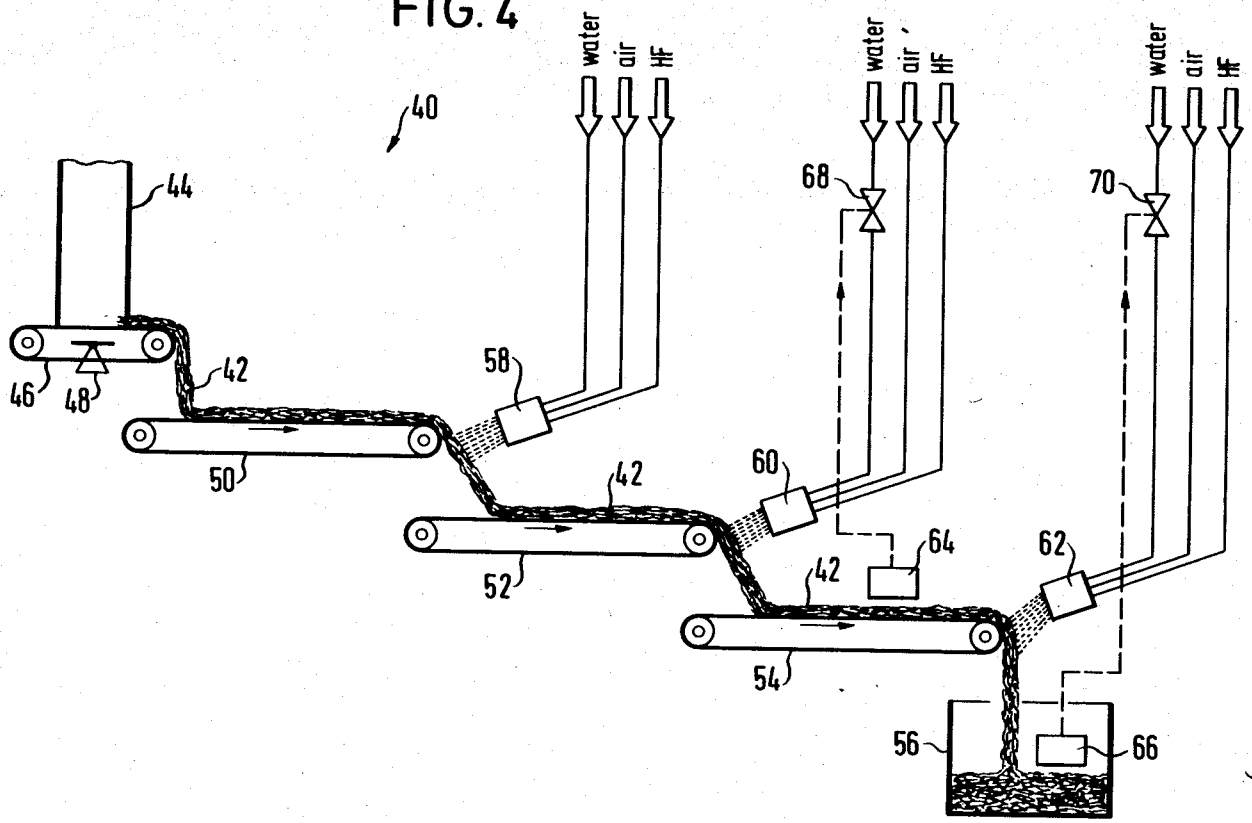
FIG. 4 shows a second form of embodiment of such an apparatus and FIG. 5 a third form of embodiment of such an apparatus.

FIG. 4 shows a further apparatus, given the general reference numeral 40, for moistening comminuted tobacco materials, this apparatus having a quantity regulating device conventional in tobacco preparation, which at the same time ascertains the tobacco throughput with respect to time. This quantity regulating device comprises an open-bottom container 44 which is arranged above a horizontally transporting conveyor belt 46 with built-in belt weighing apparatus 48. The conveyor belt 46 transports a well-defined quantity of tobacco from the container 44 and lets the appropriate stream 42 of comminuted tobacco particles fall vertically downwards on to a further conveyor belt 50, which travels rapidly.

This conveyor belt is followed by two further fast conveyor belts 52 and 54 which are each at staggered heights one behind the other, so that the stream of tobacco 42 can always fall down from the higher conveyor belt on to the particular conveyor belt situated below it.

Finally, from the last and lowest conveyor belt 54 the stream of tobacco goes down into a collecting container 56 which serves as an intermediate store. From this container the tobacco is then fed towards further processing.

Arranged at the delivery points of the three conveyor belts 50, 52 and 54 are ultrasonic atomisers 58, 60 and 62 which, as in the form of embodiment shown in FIG. 3, apply tiny droplets of water on to the freely downwardly trickling tobacco stream 42. The ultrasonic atomisers 58, 60 and 62 are supplied with water, air and high-frequency current.

Hygrometers 64, 66 are arranged at the last conveyor belt 54 and in the collecting container 56; the actual values for tobacco moisture which are obtained in this way are compared with a reference value; in accordance with the result of this comparison, regulating units 68, 70 are adjusted which adjust the water supply for the second and third ultrasonic atomisers 60, 62 respectively.

Figure 5:
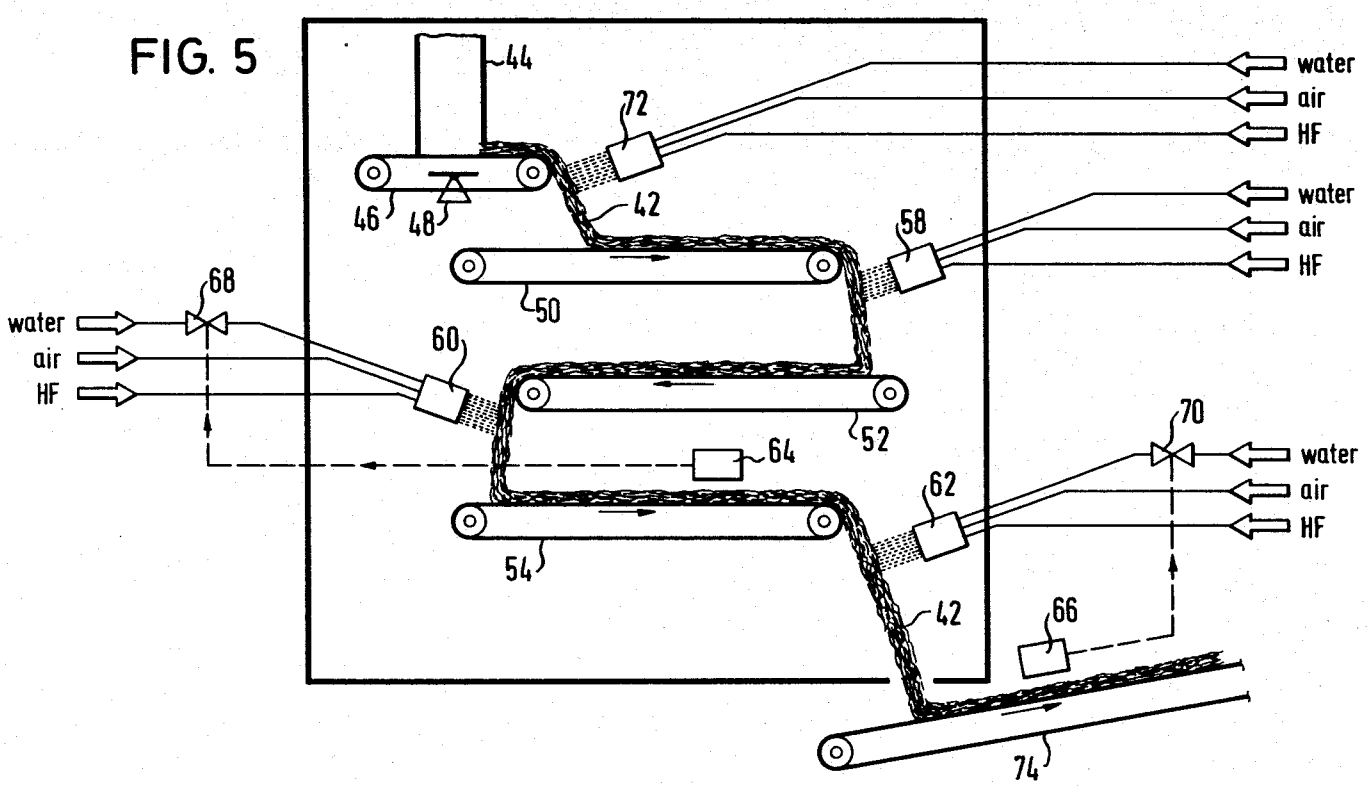

Finally, FIG. 5 shows a form of embodiment of an apparatus for the moistening of comminuted tobacco materials which operates on a similar principle to the form of embodiment shown in FIG. 4. However, the conveyor belts are arranged one above the other in vertically staggered manner in such a way that two successive conveyor belts run in opposite directions. In this way the stream of tobacco materials, which is in the form of a thin tobacco fleece, is turned.

A fourth ultrasonic atomiser 72 is also provided, applying water to the tobacco particles falling down from the conveyor belt 46. From the lowest conveyor belt 54 the tobacco particles finally fall—past the ultrasonic atomiser 62—on to a further conveyor belt 74 which feeds the moistened tobacco particles towards further processing. The moisture of the end product is measured at conveyor belt 74.

The optimal droplet range, that is to say the optimal distribution of the water droplet diameters, is achieved by appropriate adjustment of the frequency of the high-frequency current supplied to the ultrasonic atomisers. The ultrasonic atomisers can be constructed as flexural-shaft atomisers, axial or circular atomisers, or atomisers operating with standing waves.

A flexural-shaft atomiser can extend over the entire width of the tobacco fleece, so that only a single element is needed in each case.

To cover the entire width of the tobacco fleece, a plurality of axial or circular atomisers must be distributed over the entire fleece width, parallel and adjacent one another; as an alternative thereto, it is also possible to have a plurality of axial or circular atomisers laterally offset one behind the other, so as to cover the whole width of the fleece in this way.

Atomisers with standing waves operate without physical contact i.e. a stationary plate is arranged at each side of the tobacco stream; between these stationary plates ultrasonic waves are formed which likewise lead to atomisation of the supplied water.

The air used as carrier medium serves on the one hand to stabilise the finely atomised mist, and on the other hand gives the atomised water droplets a certain direction of movement, without the movement thus imparted to the water droplets damaging the delicate tobacco fibres or being able to influence the parabola over which the tobacco particles are thrown.

By comparative tests it has been possible to show that with this kind of moistening operation the delicate tobacco fibres are not damaged. Yet a very uniform moistening can be achieved, corresponding precisely to the desired final value.

If only two ultrasonic atomisers are used in the process, the first ultrasonic atomiser, regarded in the direction of convayance of the tobacco stream, should apply approximately 60% of the total water quantity, and the second ultrasonic atomiser the remaining 40% of the total water quantity.

A mixture of three different tobacco grades of Virginia type was overdried and expanded after impregnation with $CO_2$ by means of a so-called sublimator. Directly after this pre-treatment the tobacco had an oven moisture of 1% by weight and a temperature of 155° C.

For the re-moistening of this product two different processes were used, on the one hand with a conditioning drum conventional for this kind of process, and on the other hand with the apparatus shown in FIG. 5. As a further comparison a sample with the said temperature and moisture was conditioned in an air-conditioned chamber at 20° C. and a relative air moisture of 60% for 100 h, so that this tobacco had equilibrium moisture content.

The product re-moistened with the drum and the product treated with the apparatus shown in FIG. 5 were also conditioned again before physical analysis in a standard climate, so that the measurements to be explained were carried out at so-called tobacco equilibrium moisture content.

The filling capacity of these various tobacco products was then ascertained. By the filling capacity there is understood in the tobacco industry the volume, expressed for example in $cm^3$, which a specific tobacco quantity assumes when it has been loaded during a specific period of time with a specific pressure. This filling capacity can be measured in the so-called "Borgwaldt Densimeter", as described in the article "Untersuchungen mit einem verbesserten Densimeter zum Prüfen von Schnitt-Tabak und der Härte von Cigaretten" (Experiments with an improved densimeter for testing the filling capacity of cut tobacco and the hardness of cigarettes), published in "Beiträge zur Tabakforschung", Vol. 4, December 1968, page 293.

If the measurement value of the Borgwaldt Densimeter for the sample re-moistened in the air-conditioned chamber is assessed as 100%, a value of 83.8% is obtained for the re-moistening with the conventional moistening drum. Material treated in accordance with the present invention achieves 90%, so that an improvement of +6.2% has resulted.

The screen fraction with a mesh width of more than 1 mm gives, for the re-moistening with the moistening drum, a value of 85.3% and, for the re-moistening with the apparatus according to FIG. 5, a value of 96%, if the moistening in the air-conditioned chamber is put at 100%; this means that only 4% of the fibres over 1 mm have been degraded as compared with 14.7% of the fibres in the case of the conventional process.

The moistening operations were carried out in each case with service water without special additives.

The frequency of the ultrasonic atomisers amounted to 60 KHz, so that the water droplets had a maximum mean diameter of about 40 μm.

The two-component nozzles in the moistening drum are operated under conditions which seem likely to give the same mean maximum droplet diameter, but with a relatively wide distribution between minimum and maximum droplet size typical of two-component nozzles.

The quantity of water to be atomised may contain additives usual in tobacco preparation, such as for example flavouring substances.

We claim:

1. A process for remoistening comminuted smoking materials overdried during expansion thereof by moistening and cooling said smoking materials while maintaining the same substantially in the constant fibre state which comprises:

(a) moistening said smoking materials, while in a free falling state by water droplets produced by ultrasonic atomizers, nad cooling said comminuted smoking materials while flowing them along supporting surface in incremental steps to cause said smoking materials to follow the functional curve of a constant fibre state arrived at by plotting smoking materials temperature and degree of moisture in said smoking materials;

(b) repeating said incremental steps until said smoking materials reach the desired temperature and moisture condition for further processing.

2. A process as claimed in claim 1, wherein said smoking materials are conveyed for further processing and to which said droplets may be applied at the entrance of said conveyor based on the water content of said smoking materials on said conveyor.

3. A process according to claim 1, wherein the water droplets have a maximum diameter to 60 microns.

4. A process according to claim 1, wherein water droplets with an average diameter of 30–40 microns are applied.

5. A process according to claim 1, wherein the comminuted smoking materials are cooled while moving along a conveyer between the moistening steps.

6. A process according to claim 1, wherein flexural-shaft atomizers, axial atomizers, circular atomizers or ultrasonic atomizers operating with standing waves are used.

7. A procedss according to claim 1, wherein at least one cooling step the moisture of the comminuted smoking materials is ascertained and the quantity of water to be atomized is regulated in accordance with the result.

* * * * *